US006231156B1

(12) United States Patent
Ono

(10) Patent No.: US 6,231,156 B1
(45) Date of Patent: May 15, 2001

(54) INK-JET PRINTING APPARATUS AND EJECTION RECOVERY METHOD OF PRINTING HEAD

(75) Inventor: Mitsuhiro Ono, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/219,892

(22) Filed: Dec. 24, 1998

(30) Foreign Application Priority Data

Dec. 26, 1997 (JP) ..... 9-361429
Dec. 15, 1998 (JP) ..... 10-356579

(51) Int. Cl.[7] ..... B41J 2/165
(52) U.S. Cl. ..... 347/24; 347/23; 347/21
(58) Field of Search ..... 347/24, 21, 23, 347/96

(56) References Cited

U.S. PATENT DOCUMENTS

| | | | | |
|---|---|---|---|---|
| 4,313,124 | | 1/1982 | Hara | 347/57 |
| 4,345,262 | | 8/1982 | Shirato et al. | 347/10 |
| 4,459,600 | | 7/1984 | Sato et al. | 347/47 |
| 4,463,359 | | 7/1984 | Ayata et al. | 347/56 |
| 4,538,160 | * | 8/1985 | Uchiyama | 347/101 |
| 4,558,333 | | 12/1985 | Sugitani et al. | 347/65 |
| 4,723,129 | | 2/1988 | Endo et al. | 347/56 |
| 4,740,796 | | 4/1988 | Endo et al. | 347/56 |
| 5,381,169 | * | 1/1995 | Arai et al. | 347/33 |
| 5,726,692 | * | 3/1998 | Yamaguchi et al. | 347/23 |
| 5,793,388 | * | 8/1998 | Martinson et al. | 347/19 |
| 5,959,641 | * | 9/1999 | Yokoi | 347/21 |
| 5,984,450 | * | 11/1999 | Becker et al. | 347/24 |
| 5,992,966 | * | 11/1999 | Nitta et al. | 347/29 |

FOREIGN PATENT DOCUMENTS

| | | | | |
|---|---|---|---|---|
| 0 694 404 | * | 1/1996 | (EP) | 347/23 |
| 0 698 495 | * | 2/1996 | (EP) | 347/23 |
| 54-56847 | | 5/1979 | (JP) | B41M/5/26 |
| 56-84992 | | 7/1981 | (JP) | B41M/5/00 |
| 59-123670 | | 7/1984 | (JP) | B41J/3/04 |
| 59-138461 | | 8/1984 | (JP) | B41J/3/04 |
| 60-71260 | | 4/1985 | (JP) | B41J/3/04 |
| 64-63185 | | 3/1989 | (JP) | B41M/5/00 |
| 1063185 | * | 3/1989 | (JP) | B41J/3/04 |
| 3-146353 | | 6/1991 | (JP) | B41J/2/21 |
| 3-193461 | | 8/1991 | (JP) | B41J/2/18 |
| 04080041 | * | 3/1992 | (JP) | 347/23 |
| 4-158049 | | 6/1992 | (JP) | B41J/2/21 |
| 7-195823 | | 8/1995 | (JP) | B41M/5/00 |

* cited by examiner

*Primary Examiner*—N. Le
*Assistant Examiner*—Shih-wen Hsieh
(74) *Attorney, Agent, or Firm*—Fitzpatrick, Cella, Harper & Scinto

(57) ABSTRACT

In an ink-jet printing apparatus for performing printing of an image using a plurality of printing heads for ejecting an ink and a printing head for ejecting a processing liquid making the ink insoluble, a rebounding mist to be generated by ejection of the ink and the processing liquid is prevented from adhering on to the vicinity of nozzles of the printing heads. Therefore, respective number of ejection of respective of the printing heads is counted. On the other hand, a threshold level is to set smaller, at greater distance between the printing head for ejecting the ink and the printing head for ejecting the processing liquid. A recovery process, such as wiping or the like is performed when the counted value of the printing head exceeds a predetermined value. By this, appropriate recovery process, such as wiping or the like can be performed depending upon deposition amount of the mist for respective printing heads.

27 Claims, 6 Drawing Sheets

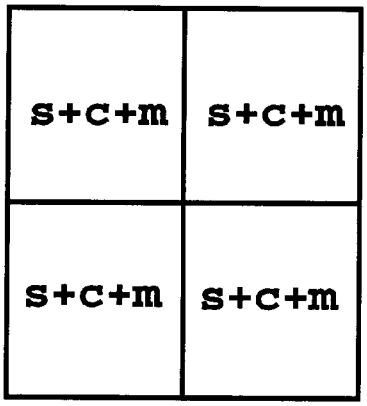
FIG.2A
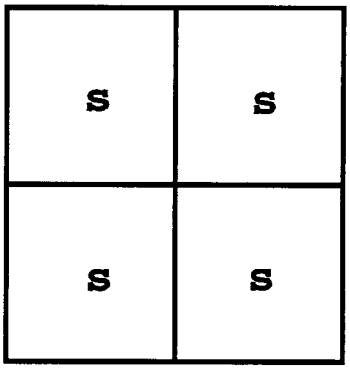
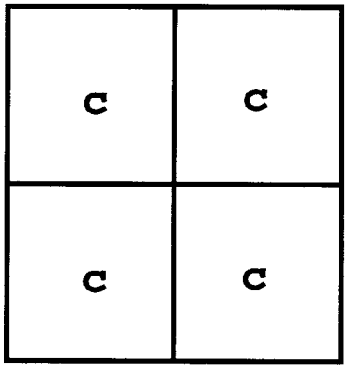
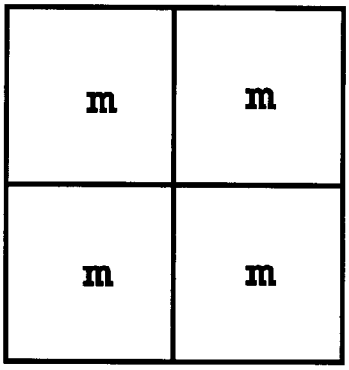
FIG.2B FIG.2C FIG.2D

INK-JET PRINTING APPARATUS AND EJECTION RECOVERY METHOD OF PRINTING HEAD

This application is based on Patent Application Nos. 9-361,429 (1997) filed on Dec. 26, 1997 and 10-356,579 (1998) filed on Dec. 15, 1998 in Japan, the content of which is incorporated hereinto by reference.

BACKGROUND OF THE INVENTION

1. Field of the Invention

The present invention relates generally to an ink-jet printing apparatus ejecting an ink toward a printing medium and an ejection recovery method of a printing head. More particularly, the invention relates to an ink-jet printing apparatus ejecting an ink and a liquid for making a coloring agent in the ink insoluble or coagulated, and an ejection recovery method of a printing head in the printing apparatus.

It should be noted that the present invention is applicable for all of devices or apparatus using a printing media, such as papers, clothes, non-woven fabrics, OHP sheets and the like (hereinafter occasionally referred to as "media"). More particularly, applicable devices may be business machines, such as a printer, a copy machine, facsimile machine and so on, a mass-production equipment, such as a textile printing machine or the like, and so on, for example.

2. Description of the Related Art

Conventionally, an ink-jet printing apparatus performing printing for a printing medium, such as paper, cloth, plastic sheet, OHP sheet and so on (hereinafter occasionally referred to as "media") can perform high density and high speed printing operation. Therefore, such ink-jet printing apparatus can be used as a printer to be used as an output device in a copy machine, a facsimile machine, an electronic typewriter, a word processor, a work station and the like, or as a handy or portable printer to be provided for a personal computer, a host computer, an optical disk device, a video device and so on. Also, such ink-jet printing apparatus has been commercialized.

In this case, the ink-jet printing apparatus takes a construction corresponding to a particular function of the apparatus, mode of use and so on. In general, the ink-jet printing apparatus includes a carriage mounting a printing head and an ink tank, a transporting means for transporting a printing paper as a printing medium, and control means for controlling the components set forth above. By scanning the printing head ejecting ink droplets from a plurality of ejection openings in a direction (primary scanning direction) perpendicular to a transporting direction of the printing paper (auxiliary scanning direction) and transporting the printing paper in an amount equal to a printing width of the printing head at an interval between scan, for printing over the entire printing paper. This method performs printing by ejecting an ink toward the printing paper from the printing head depending upon a print signal, and has been used as a printing system of low running cost and gentle for low noise. Also, in such system, by using the printing head, in which a plurality of nozzles for ejecting the ink are aligned in the auxiliary scanning direction, it becomes possible to make a printing width of scan at one time greater and whereby to achieve speeding up of printing.

Furthermore, recently, an apparatus mounting a plurality of printing heads corresponding to three to four colors of inks and performing a full-color printing, has been put into practice. Typically, in such apparatus, four kinds of printing heads corresponding to inks of three primary colors of yellow (Y), magenta (M) and cyan (C), and, in addition, black (K), and ink tanks are mounted.

However, upon formation of a color image on a plain paper by the conventional ink-jet printing method and an apparatus, prevention of bleeding of the inks between respective colors of black, yellow, magenta and cyan, and increasing of density of black image and prevention of feathering are mutually contradictory tasks. Therefore, a difficulty is encountered in obtaining high density image without causing bleeding or feathering.

Normally, upon printing of the color image on the plain paper by the ink-jet printing method, a quick drying ink having high penetration speed into the plain paper is used. Therefore, in a boundary region of respective colors forming the image, bleeding of the inks can be prevented. However, when quick drying ink is used, density of the black image becomes low. On the other hand, color image portions other than black become low in color development ability. Furthermore, upon printing of line image typically characters or the like, so-called feathering to cause bleeding of the ink along fiber of the paper can be caused. Particularly, feathering of characters printed by black ink can be easily perceived in comparison with other color to be the unclear characters for insufficient sharpness. As a result, as a whole, quality of the printed image can be significantly degraded.

In general, in order to obtain high quality image with high density of a black image portion and without causing feathering, it is required to deposit an ink having relatively low penetration speed into the plain paper at large amount in certain extent. However, in this case, bleeding of the black ink and the color ink can be caused at an interface portion between black image portion and the color image portion to degrade quality of the printed image.

In order to improve the foregoing drawback, a system obtain a color image of high color development with no bleeding, by promoting drying of the ink by providing a heater within the printing apparatus, and has been commercialized.

However, in this system, it is inherent that the apparatus becomes bulky and high cost.

As set forth above, prevention of bleeding between black and other colors, and achieving high density of the black image and prevention of feathering have been contradictory tasks inherently require trade off therebetween.

Therefore, in Japanese Patent Application Laid-open No. 3-146353 (1991), for example, there has been proposed a system not to effect printing for a region along an interface between a printing regions of the black ink and the color ink. However, in this system, a drawback is encountered in causing variation of the printed data. On the other hand, in Japanese Patent Application Laid-open No. 4-158049 (1992), there has been proposed a method for performing printing by switching a plurality of heads for color printing and a head for character printing. In this method, when the black image printed by the color printing heads and the black image printed by the character printing head are present in admixing manner, unpleasant sensation should be caused due to difference of printing quality of the black images. Furthermore, a method for preventing bleeding in a black region along the boundary between the printed regions printed by black ink and the color ink, by overlapping printing of the color ink, has been considered. In principle, while black can be obtained by overlaying three primary colors Y, M and C (color mixing). However, in most case, the black image formed by color mixing of the color inks has lower color development than the normal black image formed by the black ink.

On the other hand, in Japanese Patent Applications Laid-open Nos. 56-84992 (1981) and 64- 63185 (1989), technologies using a liquid making dye in the ink insoluble have been disclosed.

Amongst, in Japanese Patent Application Laid-open No. 56-84992, a method to preliminarily apply a material for fixing the dye on a printing paper has been disclosed. However, in the method, particular printing paper has to be used. Also, in order to preliminarily apply the material for fixing the dye, it is inherent that the apparatus becomes bulky and high cost. Furthermore, it is difficult to stably apply the material on the printing paper in a predetermined thickness.

On the other hand, in Japanese Patent Application Laid-open No. 64-63185 (1988), a technology for depositing an achromatic ink for making the dye insoluble on the printing paper by an ink-jet printing head, has been disclosed. According to the disclosure, since the dot of the achromatic ink is formed to have greater diameter than the dot formed by an image forming ink, a desired printing characteristics can be satisfied even when offset is cased between depositing positions of the achromatic ink and the image forming ink.

Furthermore, in Japanese Patent Application Laid-open No. 7-195823 (1995), color printing by one path of the printing head is permitted by applying an achromatic precursor on the surface of the printing medium in advance of ink-jet printing.

As set forth above, the methods disclosed in the foregoing publications hold problems to be solved. However, since the dye in the ink is made insoluble, bleeding between respective color inks may be prevented.

The applicant of the present application has already proposed an ink-jet printing method which can solve the problems set forth above and achieving low running cost by restricting consumption of an ink which make a dye insoluble. With the proposed printing method, superior water resistance than prior art can be achieved even on the plain paper, higher density image can be obtained. Furthermore, as applied for color printing, an image of high color development without bleeding between colors can be obtained.

However, in the conventional ink-jet printing apparatus using a liquid making the image forming ink insoluble (hereinafter referred to as "processing liquid"), it is possible that a mixture (hereinafter referred to as "mixture mist") of the image forming ink (hereinafter simply referred to as "ink") and the processing liquid deposits in the vicinity of a nozzle array of the printing head for ejecting the ink or the processing liquid. In such case, the processing liquid and the ink may react to generate a solidified substance to be a cause of ejection failure of the ink or the processing liquid.

Conventionally, there has not been known any ejection recovery method which can effectively prevent generation of the mixture mist on the nozzle or therearound, and effectively remove the generated mixture mist in order to keep high quality printing for a long period.

SUMMARY OF THE INVENTION

The present invention is worked out for solving the problems set out above. Therefore, it is an object of the present invention to provide an ink-jet printing apparatus and an ejection recovery method which can constantly perform high quality printing by performing recovery process, such as wiping, sweeping and so on at an appropriate interval in order to prevent ink, processing liquid or a mixture mist thereof from solidifying depositing in the vicinity of a nozzle.

In a first aspect of the present invention, there is provided an ink-jet printing apparatus using a plurality of printing heads which can eject an ink and a printing head which can eject a processing liquid for making a coloring material in the ink insoluble, for printing an image on a printing medium by the ink and the processing liquid ejected from the printing heads respectively, wherein an ejection recovery condition for recovering an ejection condition of respective of the plurality of printing heads are differentiated depending upon possibility causing deposition of the ink and/or the processing liquid on to each of the plurality of printing heads.

In a second aspect of the present invention, there is provided an ink-jet printing apparatus using a plurality of ejecting portions which can eject an ink and a ejecting portion which can eject a processing liquid for making a coloring material in the ink insoluble, for printing an image on a printing medium by the ink and the processing liquid ejected from the ejecting portions respectively, wherein an ejection recovery condition for recovering an ejection condition of respective of the plurality of ejecting portions are differentiated depending upon possibility causing deposition of the ink and/or the processing liquid on to each of the plurality of ejecting portions.

In a third aspect of the present invention, there is provided an ejection recovery method of a printing head in an ink-jet printing apparatus using a plurality of printing heads which can eject an ink and a printing head which can eject a processing liquid for making a coloring material in the ink insoluble, for printing an image on a printing medium by the ink and the processing liquid ejected from the printing heads respectively, wherein an ejection recovery condition for recovering an ejection condition of respective of the plurality of printing heads are differentiated depending upon possibility causing deposition of the ink and/or the processing liquid on to each of the plurality of printing heads.

In a fourth aspect of the present invention, there is provided an ejection recovery method of a printing head in an ink-jet printing apparatus using a plurality of ejecting portions which can eject an ink and a ejecting portion which can eject a processing liquid for making a coloring material in the ink insoluble, for printing an image on a printing medium by the ink and the processing liquid ejected from the ejecting portions respectively, wherein an ejection recovery condition for recovering an ejection condition of respective of the plurality of ejecting portions are differentiated depending upon possibility causing deposition of the ink and/or the processing liquid on to each of the plurality of ejecting portions.

With the construction set forth above, an ejection recovery condition for respective of a plurality of printing heads are differentiated depending upon possibility of occurrence of deposition of the ink, the processing liquid or the mixture mist on to the printing heads. For example, ejection recovery conditions thereof are differentiated depending upon distances between respective printing heads for ejecting the inks and the printing head for ejecting the processing liquid. Preferably, frequency of the ejection recovery process is set higher at shorter distance to the printing head for ejecting the processing liquid. In the alternative, the ejection recovery conditions are differentiated depending upon kinds of the ink to be ejected. Preferably, frequency of the ejection recovery process is set higher for the ink having higher coagulation ability. As a result, frequency of the ejection recovery process can be set higher for the printing head having higher possibility of causing greater amount of deposition of the ink, the processing liquid or the mixture mist in the vicinity of the ejection openings by ejection.

BRIEF DESCRIPTION OF THE DRAWING

FIGS. 2A, 2B, 2C and 2D are explanatory illustration for explaining one embodiment of a printing method according to the present invention;

DETAILED DESCRIPTION OF THE PREFERRED EMBODIMENT

The preferred embodiment of the present invention will be explained hereinafter in detail with reference to the drawings.

Figure 1A:
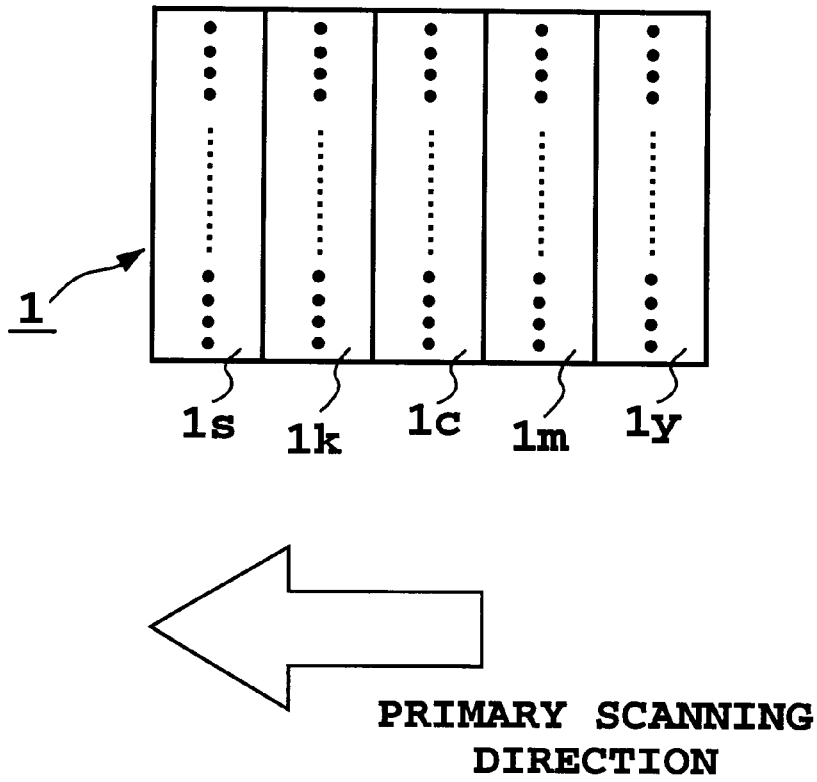
FIGS. 1A and 1B are explanatory illustrations for explaining a construction of one embodiment of a printing head according to the present invention and a printing method thereof.
Figure 1B:
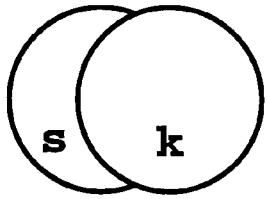

FIG. 1A is an illustration diagrammatically, showing one embodiment of a printing head array and an ejection opening surface according to the present invention. In the shown embodiment, a printing head 1*s* for ejecting a processing liquid (s), a printing head 1*k* for ejecting a black ink (k), a printing head 1*c* for ejecting a cyan ink (c), a printing head 1*m* for ejecting a magenta ink (m) and a printing head 1*y* for ejecting a yellow ink (y) are arranged in sequential order. On the other hand, in printing operation, in relationship between a direction of a primary scanning direction shown by arrow of FIG. 1A and an arrangement order of respective heads, the processing liquid (s), the black ink (k), the cyan ink (c), the magenta ink (m) and the yellow ink (y) are ejected in sequential order. For example, as shown in FIG. 1B, ink dots of the processing liquid (s) and the black ink (k) are formed in overlapping fashion.

FIGS. 2A, 2B, 2C and 2D are illustrations for explaining one example of a process for ejecting the processing liquid and the ink for each pixel on the basis of the construction set forth above. FIG. 2A explains dot formation in 2×2 pixels of a part of an image to be printed, in which each pixel is formed by the processing liquid (s), the cyan ink (c) and the magenta ink (m). In order to obtain the image shown in FIG. 2A, with scanning the printing head shown in FIGS. 1A and 1B in a primary scanning direction, at first, as shown in FIG. 2B, the processing liquid (s) is ejected by the printing head 1*s*. Subsequently, as shown in FIG. 2C, the cyan ink (c) is ejected by the printing head 1*c*. Finally, as shown in FIG. 2D, a magenta ink (m) is ejected for respective pixels by the printing head 1*m*.

Here, it has been confirmed by the inventors that the ink and the processing liquid may contact on a surface formed with ejection openings of each printing head (hereinafter referred to as "face plain" or "ejection opening surface") to react thereon to cause adhering. When adhering is caused, it is possible to cause offset in the ejecting direction of the ink droplet subsequently ejected or to cause plugging of the ejection opening to cause significant influence for reliability. Furthermore, such adhering of the reaction product should significantly influence for coagulation ability of the processing liquid and the ink. In case of the shown embodiment, since coagulation ability of the cyan ink (c) and the processing liquid (s) is the highest, the reliability of the printing head 1*c* for ejection of cyan ink (c) becomes the worst.

As one factor of contacting of the ink and the processing liquid on the printing head, rebounding from a printing medium caused upon ejection of the ink and the processing liquid to the printing medium, can be considered. Concerning to this, with taking the case of the black ink and the processing liquid as an example, rebounding phenomenon in the printing process will be explained with reference to diagrammatic illustrations shown in FIGS. 3A, 3B and 3C.

Figure 3A:
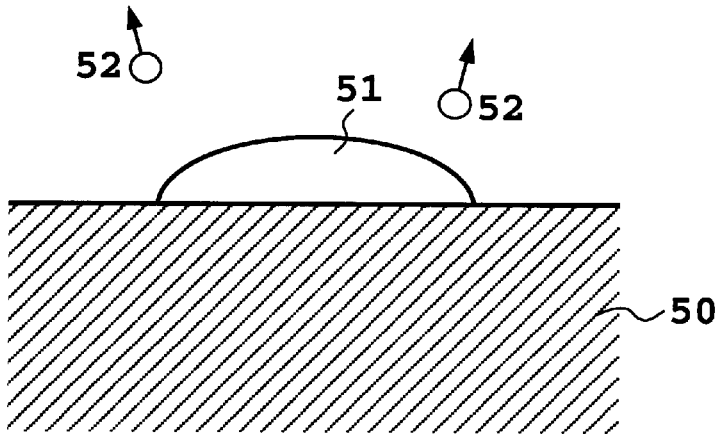
FIGS. 3A, 3B and 3C are explanatory illustrations for explaining rebounding of fine liquid droplet of a mixture of an ink and a processing liquid.

FIG. 3A is an illustration showing a behavior of the droplets of the ink 51 and the processing liquid 51 as rebounded upon hitting on the printing medium. As can be clear from FIG. 3A, fine liquid droplet 52 caused by rebounding flies in the opposite direction to the printing medium 50, namely toward the ejection opening surface of the printing head. In the shown embodiment, the liquid initially ejected in scan is the processing liquid in the most case. Therefore, in most case, the fine liquid droplet in rebounding becomes the processing liquid.

Figure 3B:
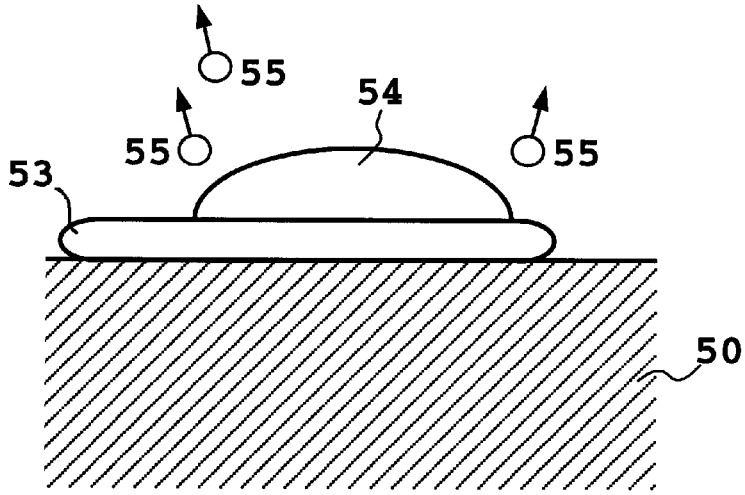

FIG. 3B shows a behavior of the rebounded droplet to be caused when the ink 54 is applied after application of the processing liquid 53 on the printing medium. In this case, the ink 54 is applied to the layer of the processing liquid 53 which is applied in advance, similarly to FIG. 3A, fine droplet 55 generated by rebounding flies in the direction opposite to the printing medium 50, namely toward the ejection opening surface of the printing head.

Figure 3C:
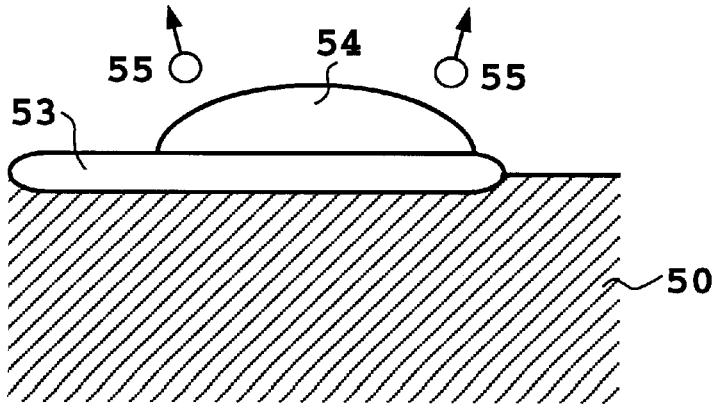

FIG. 3C shows a behavior of the rebounded droplet 55 to be caused when the ink 54 is applied after a longer elapsed period than the case shown in FIG. 3B, after application of the processing liquid 53 on the printing medium 50. In this case, since the layer of the processing liquid 53 applied in advance is penetrated into the printing medium 50, an amount of flying of the fine liquid droplet 55 by rebounding becomes smaller. Thus, occurrence of the fine liquid droplet by rebounding depends on an elapsed time from ejection of the processing liquid to ejection of the ink.

As shown in FIGS. 1A and 1B, in the shown embodiment, the black ink (k) is ejected at first after ejection of the processing liquid (s). Therefore, upon ejection of the black ink (k) by the printing head 1*k*, amount of generation of the fine liquid droplet due to rebounding becomes large. Conversely, upon ejection of the yellow ink (y) by the printing head 1*y*, amount of generation of the fine liquid droplet due to rebounding becomes small. On the other hand, possibility of occurrence of deposition of the mixture mist of the ink and the processing liquid can be different depending upon kind of ink.

The shown embodiment of the present invention has been worked out in view of the foregoing point. Therefore, by differentiating a condition for recovery process of respective printing heads depending upon distance from the printing head for ejecting the processing liquid, reliability of printing can be maintained for a long period. On the other hand, in another embodiment of the present invention, by differentiating the condition of the recovery process of the printing head depending upon kind of the ink to be ejected, reliability of printing can be maintained for a long period.

More particularly, for the printing head of each ink, number of times of the ink ejection is counted. Concerning printing heads of respective inks, threshold values depending upon distances from the printing head for processing liquid or threshold values depending upon kinds of the inks to be ejected are preliminarily determined. When the counted values of the printing heads of respective inks exceed the threshold values of the printing head for the inks, recovery process is performed.

It should be noted that form of the printing head, to which the present invention is applied, is not limited to the construction, in which the heads for respective inks are independent of the other as shown in FIG. 1. As constructions of the printing heads, integraltype, in which the heads are integrated and the ejection openings per the ink and liquid chambers and so on communicated to the ejection openings are internally separated, may be employed. In this case, it is clear that the foregoing distance becomes a distance between the ejecting portions (strictly between the ejection openings) of respective inks.

Hereinafter, the preferred embodiment of the present invention will be explained in greater detail with reference to the drawings.

(First Embodiment)

Figure 4:
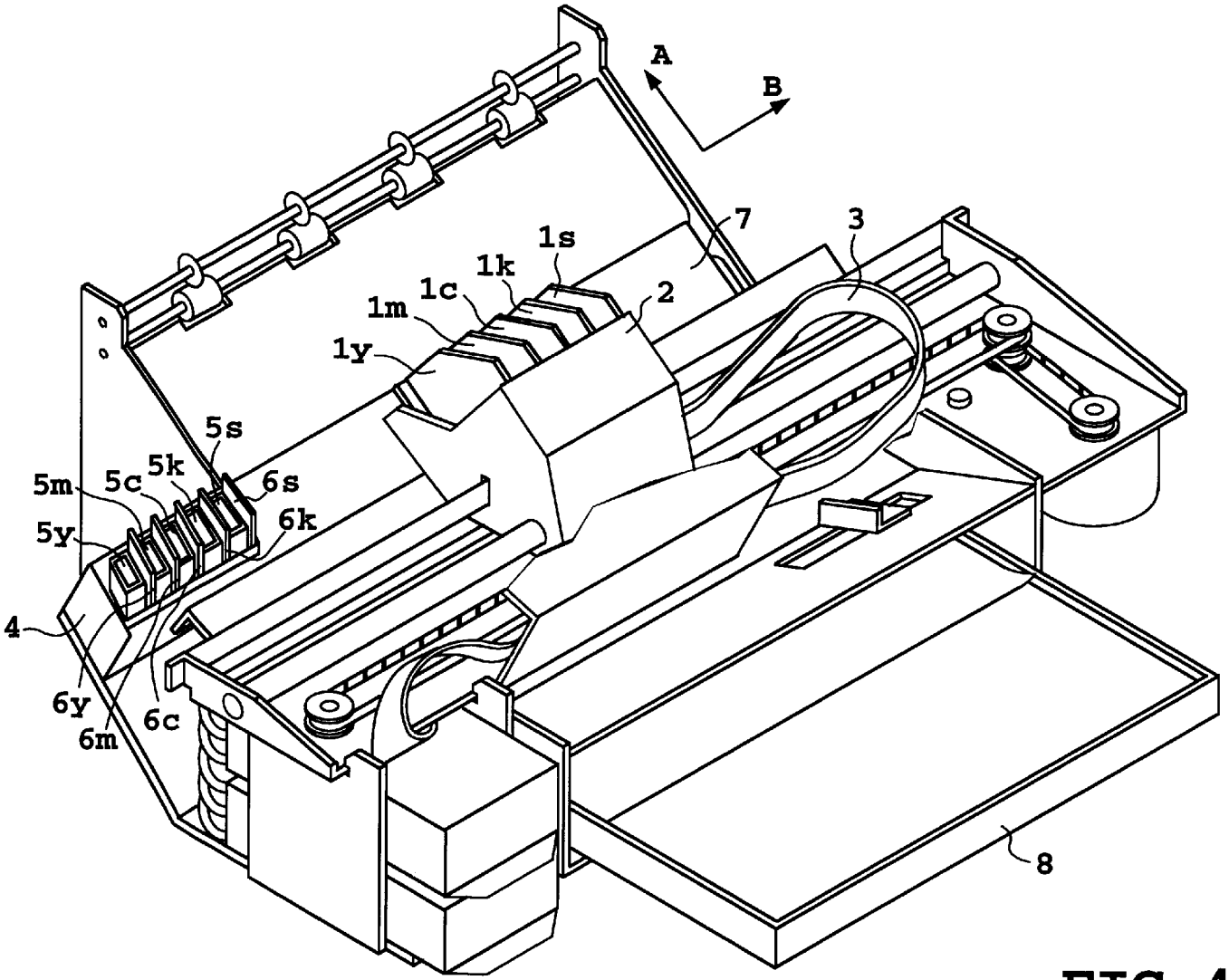
FIG. 4 is a general perspective view of the first embodiment of an ink-jet printer according to the present invention.

FIG. 4 is a perspective view showing a general construction of one embodiment of the ink-jet printing apparatus, to which the present invention is applicable.

The shown embodiment of the printer has a carriage 2. On the carriage 2, the printing head is for ejecting a processing liquid (s), a printing head 1*k* for ejecting a black ink (k), a printing head 1*c* for ejecting a cyan ink (c), a printing head 1*m* for ejecting a magenta ink (m) and a printing head 1*y* for ejecting a yellow ink (y) are mounted. Furthermore, the printer has a flexible cable 3 for feeding an electrical signal from a printer main body to the printing heads, a capping unit 4 as an ejection recovery mechanism, a paper feeding tray 8 for feeding a paper 7 as the printing medium, and so on. The capping unit 4 is constituted of capping members 5*s*, 5*k*, 5*c*, 5*m* and 5*y* respectively corresponding to the printing heads 1*s*, 1*k*, 1*c*, 1*m* and 1*y*, and wiper blades 6*s*, 6*k*, 6*c*, 6*m* and 6*y* formed of a rubber or the like and corresponding to the printing heads 1*s*, 1*k*, 1*c*, 1*m* and 1*y*. These wiper blades are provided for motion toward and away from motion paths of the printing heads. These wiper blades are provided to project from faces of respective capping members, in the normal condition. By this, associating with movement of the printing heads, wiping of the ejection opening surfaces in the corresponding printing heads can be performed. On the other hand, respective capping members move toward respective of opposing printing heads upon capping to establish capping.

The printer having the construction set forth above performs serial scan of the printing heads 1*s*, 1*k*, 1*c*, 1*m* and 1*y* in a direction B (primary scanning direction) perpendicular to a transporting direction A of the paper 7 to perform printing in a width corresponding to number of nozzles. By transporting the paper 7 in a feeding amount corresponding to the printing width (width corresponding to number of nozzles) in an interval between primary scan, printing is performed on the paper 7 sequentially. Each of the printing head is, 1*k*, 1*c*, 1*m* and 1*y* is arranged 64 nozzles in a density of 360 per one inch. From each nozzle, about 40 ng of the processing liquid and the ink is ejected. Accordingly, the printing density in the auxiliary scanning direction is 360 dpi. Associating with this, the printing density in the primary scanning direction is 360 dpi.

Figure 5:
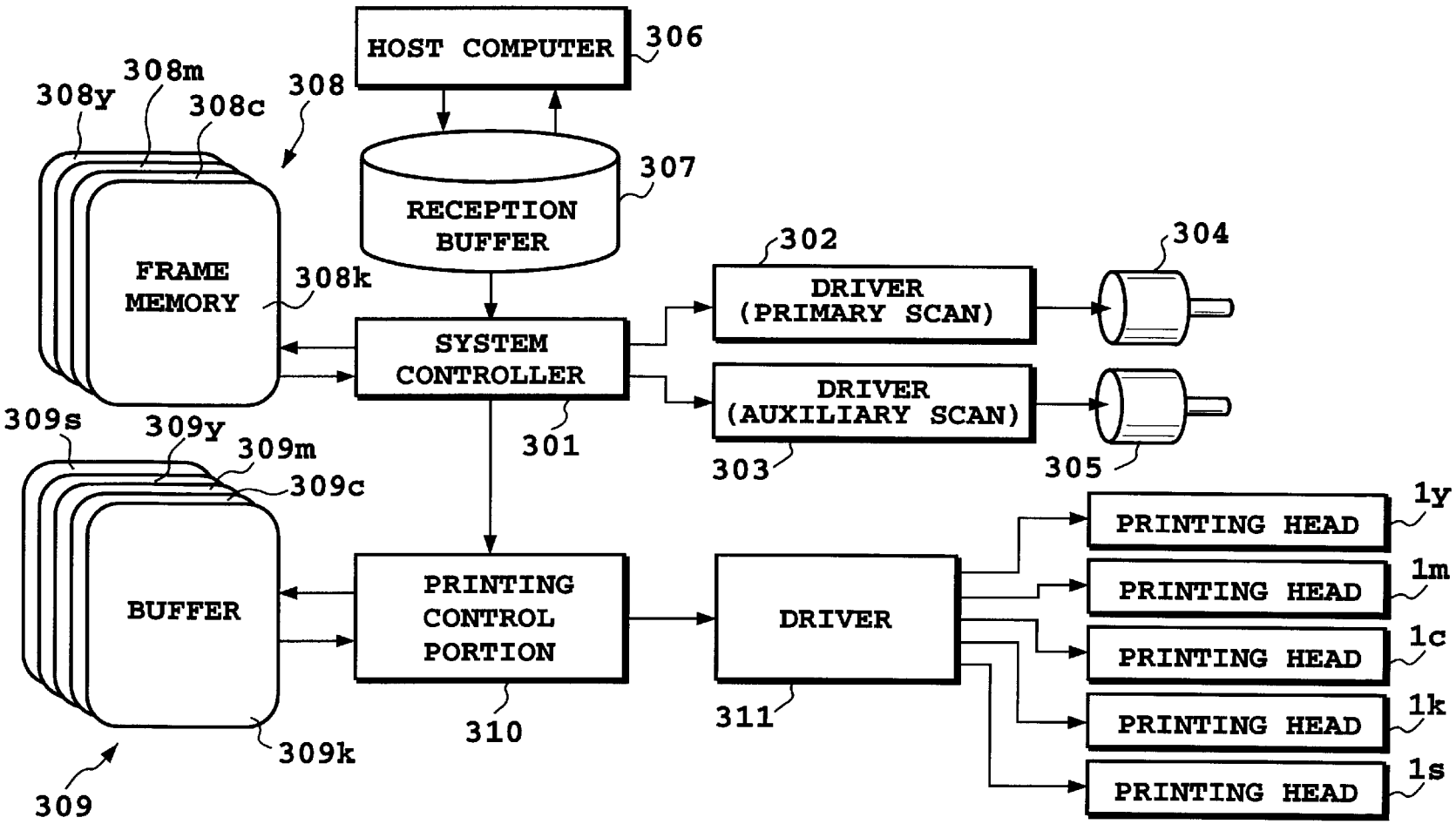
FIG. 5 is a block diagram showing a construction of a control system of the ink-jet printer of FIG. 4.

FIG. 5 is a block diagram showing a construction of the control system of the ink-jet printer set forth above.

In FIG. 5, the reference numeral 301 denotes a system controller for controlling the overall apparatus. In the system controller 301, a microprocessor (MPU), ROM storing control program, RAM to be used as a work area when the microprocessor executes a process, and so on. The system controller 301 may be designed to perform recovery control which will be explained later, according to the control program. It should be noted that major control of the shown embodiment including the recovery process and so on is performed under control executed by a host computer 306.

The reference numeral 302 denotes a driver for performing driving control of a motor 304 for driving a carriage 2 mounting the printing heads. The reference numeral 303 denotes a driver for performing driving control of a motor 305 for transporting the paper 7 in the auxiliary scanning direction.

The reference numeral 306 denotes a host computer and transfers a printing data or the like with respect to the shown embodiment of the printer. The reference numeral 307 denotes a reception buffer for temporarily storing data from the host computer 306, which accumulates data until data is read from the system controller 301. The reference numeral 308 denotes a frame memory provided per respective ink (k, c, m, y) for developing the printing data into an image data, having a memory size necessary for printing. In this embodiment, the frame memory 308 having a memory size for storing a printing data for one page of the paper 7. It should be noted that the present invention is not limited to the size of the frame memory 308, as a matter of course. The reference numeral 309 is a buffer for temporarily storing a printing data for one scan of the printing head, which buffer 309 is provided for each ink color (k, c, m, y). In the buffer 309, the printing data for one scan derived through processes of color conversion, density correction and so on and binarization process is received from the host computer 306. Together with preparation of the printing data, on the basis of the printing data, ejection data of the processing liquid is prepared according to a predetermined rule (hereinafter occasionally referred to as "processing liquid data"). The processing liquid data is stored in the buffer 309*s*. It should be noted that as the rule for preparing the processing liquid data, a rule to make the processing liquid data "1" (ejection) when the printing data of each ink color (y, m, c, k) corresponding thereto is "1" (ejection).

The reference numeral 310 denotes a printing control portion for controlling the printing head on the basis of control of the system controller 301. Namely, the printing control portion 310 controls a printing speed, number of printing data and so on. Furthermore, preparation of data is also performed for ejecting the processing liquid as set forth above. On the other hand, counting of printing duty of the image to be printed by one time of scan of the printing head is also performed. The reference numeral 311 is a driver for driving the printing head is for ejecting the processing liquid and the printing heads 1*y*, 1*m*, 1*c* and 1*k* for ejecting respective inks of y, m, c, k.

In the construction set forth above, the transferred image data from the host computer 306 is temporarily stored in the reception buffer 307. Next, the image data stored in the reception buffer 307 is read out by the system controller 301. After performing the foregoing process, the image data is developed to the buffer 309. Then, the printing control portion 310 controls the printing heads on the basis of the printing data and the processing liquid data in the buffer 309.

Here, since a mixture mist is generated by ejection of the ink and ejection of the processing liquid, amount of the mixture mist becomes greater at closer distance between the nozzle ejecting the ink and the nozzle ejecting the processing liquid (printing enhancement liquid) to cause harmful influence for ink ejection. Namely, deposition amount of the mixture mist depends upon a distance between the printing head for the ink and the printing head for the processing liquid. In the shown embodiment of the printer, the printing head for the ink located at the closest position to the printing head 1*s* for ejecting the processing liquid is the printing head 1*k* for black ink. Therefore, the printing head 1*k* is influenced by the mixture mist most significantly. Conversely, the printing head 1*y* located at the greatest distance from the printing head 1*s* is influenced by the least influence of the mixture mist.

In consideration of the foregoing point, in the foregoing embodiment, number of times of ejection of respective inks of the printing heads 1*k*, 1*c*, 1*m* and 1*y* (hereinafter referred to "dot count") are counted. Furthermore, depending upon a distances of the printing heads (1*k*, 1*c*, 1*m* and 1*y*) from the printing head 1*s*, threshold values are determined. Then, when the counted value of the dot count of the printing head 1*k*, 1*c*, 1*m* and 1*y* (hereinafter referred to as "dot count value") exceeds the threshold value, recovery process for the printing heads for the corresponding ink and the printing head for the processing liquid is performed.

For particular explanation, the counted values of the printing heads 1*k*, 1*c*, 1*m* and 1*y* are respectively ck, cc, cm and cy, and distances between respective printing heads 1*k*, 1*c*, 1*m*, 1*y* for the inks and the printing head is for the processing liquid are dk, dc, dm and dy. On the other hand, the threshold value $t_i$ expressed by the following equation (1) is determined.

$$t_i = K \times d_i \quad (1)$$

wherein i=k, c, m, y, and K is a predetermined constant

Figure 6:
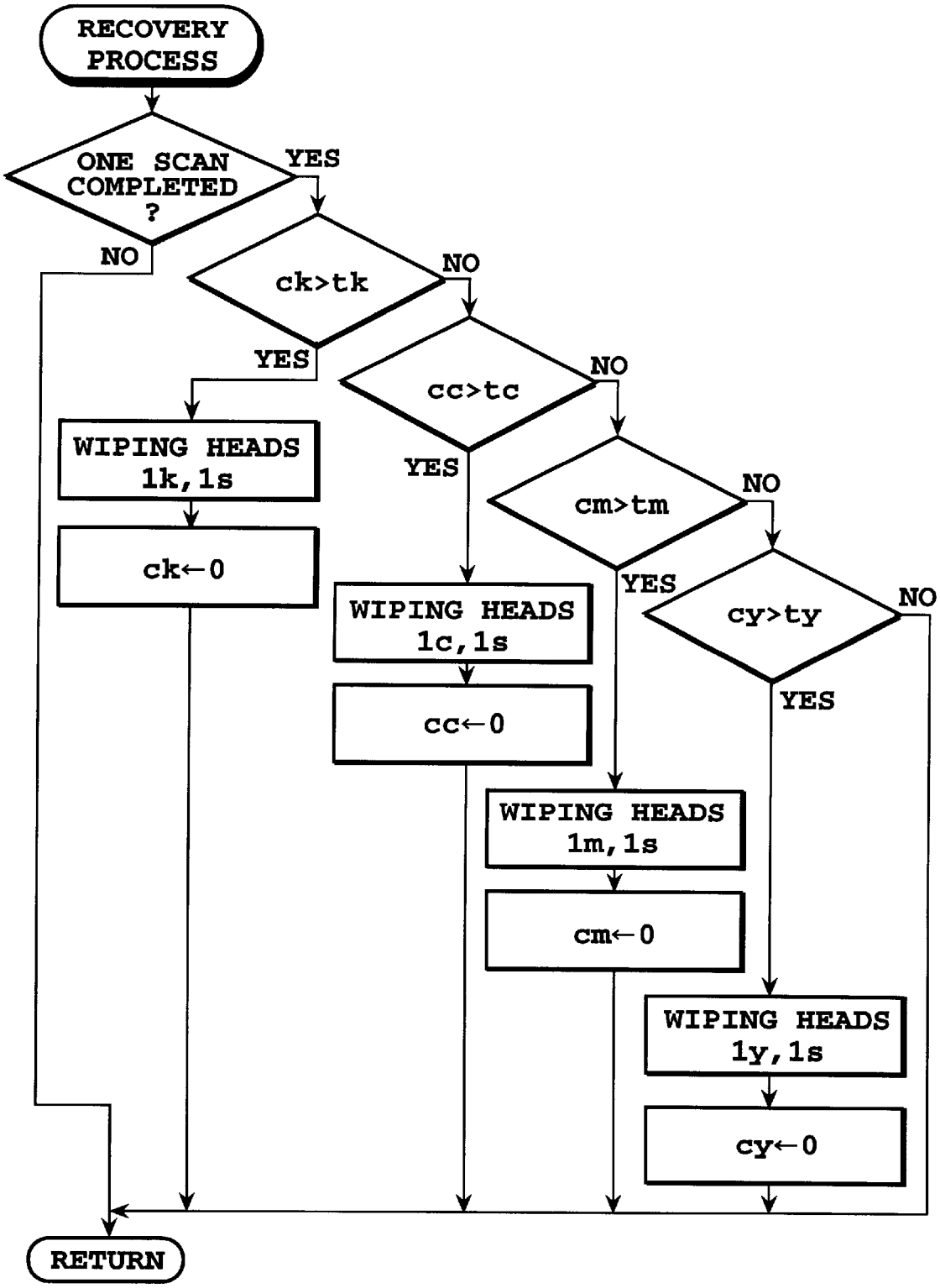
FIG. 6 is flowchart for explaining a recovery process of the ink-jet printer of FIG. 4.

When any one of the dot count values ck, cc. cm and cy of the printing heads for the ink exceeds the threshold value $t_i$ ($t_k$, $t_c$, $t_m$, $t_y$), wiping is performed only for the printing head of the corresponding ink and the printing head of the processing liquid is performed. Then, the dot counted value corresponding to the printing head for which wiping is effected, is initialized. FIG. 6 is a flowchart showing such recovery process. In the shown embodiment, when ever the printing head finishes one scan, dot counter value is compared with the threshold value. For example, when the dot counted value ck of the printing head 1*k* exceeds the threshold value $t_k$, the dot counted value ck is cleared after wiping the printing head 1*k* and the printing head is for the processing liquid.

As a result of the process set forth above, any printing heads can be prevented from deposition of the mixture mist greater than or equal to a given amount. On the other hand, lowering of throughput by performing wiping can be restricted to be minimum.

In the shown embodiment, distances between the printing head 1*k*, 1*c*, 1*m* and 1*y* and the printing head 1*s* for the processing liquid are respectively 0.5 inch, 1.0 inch, 1.5 inches, 2.0 inches. These distances are distances between the ejection openings in the printing heads in the primary scanning direction. On the other hand, in the shown embodiment, the constant K used for deriving the threshold value is 12672000. On the other hand, dk, dc, dm and dy using the shown embodiment are 5, 10, 15, 20, respectively.

On the other hand, in the shown embodiment, the inks and the processing liquid have the following compositions:

| | |
|---|---|
| (Black Ink) | |
| glycerin | 7.5 parts by weight |
| thiodiglycol | 7.5 parts by weight |
| urea | 7.5 parts by weight |
| IJA260 (10% aqueous solution) | 9.5 parts by weight |
| Project Fast Black2 (10% aqueous solution) | 36.5 parts by weight |
| Daiwa Yellow 330EP | 0.27 parts by weight |
| Direct Blue 199 (10% aqueous solution) | 7.2 parts by weight |
| isopropyl alcohol | 4 parts by weight |
| water | 19.22 parts by weight |
| ammonium sulfate | 0.45 parts by weight |
| NaOH | 0.36 parts by weight |
| (Yellow Ink) | |
| glycerin | 7.5 parts by weight |
| thiodiglycol | 7.5 parts by weight |
| urea | 7.5 parts by weight |
| IJA260 (10% aqueous solution) | 9.5 parts by weight |
| Project Fast Yellow2 (10% aqueous solution) | 43.48 parts by weight |
| water | 17.55 parts by weight |
| acetylenol EH (tradename: manufactured by Kawaken Fine Chemical Co., Ltd.) | 0.1 parts by weight |
| triethanolamine | 0.74 parts by weight |
| 4H-lithium hydroxide | 1.88 parts by weight |
| ammonium sulfate | 0.25 parts by weight |
| isopropyl alcohol | 4 parts by weight |
| (Magenta Ink) | |
| glycerin | 7.5 parts by weight |
| thiodiglycol | 7.5 parts by weight |
| urea | 7.5 parts by weight |
| Project Fast Magenta2 (10% aqueous solution) | 45 parts by weight |
| ammonium sulfate | 0.27 parts by weight |
| water | 25.43 parts by weight |
| acetylenol EH | 0.1 parts by weight |
| 10%-LiOH | 1.84 parts by weight |
| triethanolamine | 0.86 parts by weight |
| isopropyl alcohol | 4 parts by weight |
| (Cyan Ink) | |
| glycerin | 7.5 parts by weight |
| thiodiglycol | 7.5 parts by weight |
| urea | 7.5 parts by weight |
| Project Blue 199 (10% aqueous solution) | 28 parts by weight |
| acetylenol EH | 0.1 parts by weight |
| water | 43.1 parts by weight |
| isopropyl alcohol | 4 parts by weight |
| 10%-LiOH | 2.0 parts by weight |
| ammonium sulfate | 0.3 parts by weight |
| (Processing liquid) | |
| glycerin | 7 parts by weight |
| thiodiglycol | 5 parts by weight |
| PAA-IL-15B (15% aqueous solution) | 24 parts by weight |
| acetic acid | 3.51 parts by weight |
| benzalkonium chloride | 1.92 parts by weight |
| TEGMB | 0.95 parts by weight |
| water | 57.62 parts by weight |

It should be noted that while the printing heads are arranged in sequential order of the processing liquid, the black ink, the cyan ink, the magenta ink and the yellow ink in the shown embodiment, application of the present invention is not restricted to the order or number.

On the other hand, while the threshold value to perform wiping is determined according to the equation (1), manner of determining the threshold value is not limited to the shown manner. For instance, the threshold values may be set independently for each printing head. In any case, the threshold value is set to be greater at greater distance from the printing head for ejecting the processing liquid.

On the other hand, it is also possible to take an elapsed time from the preceding recovery operation set for each individual head, as a reference, for example. Namely, by setting a predetermined reference period per each printing head for the ink as the threshold value, recovery process is performed for the printing heads for the relevant ink and the printing head for the processing liquid when the elapsed time from the preceding recovery operation exceeds the reference period. In this case, the period is set longer for greater distance from the printing head for ejecting the processing liquid.

Furthermore, it is also possible that the timing of the recovery operation for all of the printing heads is set at the same timing to vary number of recovery operation depending upon the distance from the printing head for ejecting the processing liquid to attain the same result.

(Second Embodiment)

The shown embodiment differentiates the operating condition of the wiping in the first embodiment of the ink-jet printing apparatus. Namely, the first embodiment employs five wiper blades corresponding to respective printing heads and operative independently of each other. In contrast to this, the shown embodiment has single wiper blade 6 (not shown) corresponding to the printing heads 1*s*, 1*k*, 1*c*, 1*m* and 1*y*. Namely, the wiper blade 6 is an integrated type which can perform wiping for all of the printing heads 1*s*, 1*k*, 1*c*, 1*m* and 1*y*.

A timing to wiping is determined in the same manner as the first embodiment. Namely, similarly to the first embodiment, by providing the threshold value, wiping is performed when dot counted value of any one of the printing head exceeds the threshold value. In this case, as set forth above, since the shown embodiment has a construction employing an integrated type wiper blade, wiping is performed for all of the printing heads. Then, dot counted values of all of the printing heads are initialized simultaneously.

As a result of the process set forth above, similarly to the first embodiment, it becomes possible to prevent from deposition of the mixture mist exceeding a predetermined amount on any printing heads.

It should be noted that, in the shown embodiment, the same ink and the same processing liquid as those used in the first embodiment are used.

(Third Embodiment)

The shown embodiment is constructed by applying the present invention for setting operating condition of sweeping by a sweeping member in place of the operating condition of the wiper blade, in the first embodiment of the ink-jet printing apparatus. Namely, while the first embodiment employs the wiper blade operating independently for each printing head, the shown embodiment includes sweeping members corresponding to respective printing heads and being operable independently of each other. Recovery operation for each printing head by the sweeping member is controlled by the dot counted value to guarantee reliability of printing.

Particularly, by the same equation as the equation (1) of the first embodiment, the threshold value for the printing head for the ink is determined. When the dot counter value of the printing head for the ink exceeds the corresponding threshold value, sweeping operation by the sweeping member only for the printing head of the relevant ink and the printing head for the processing liquid is performed. Then, the dot counted values corresponding to the printing head, for which the sweeping operation is performed, are initialized. As a result, for any of the printing head, deposition of the mixture mist exceeding a predetermined amount can be prevented. Furthermore, lowering of throughput by the sweeping operation can be minimized.

It should be noted that the constant K (see equation (1)) used for deriving the threshold value in the shown embodiment is 126720000, and distances dk, dc, dm and dy are the same as those used for the first embodiment. On the other hand, in the shown embodiment, the ink and the processing liquid are the same as those used for the first embodiment. Furthermore, the sweeping member used in the shown embodiment is formed with a shaped foamed body. However, the material is not limited to this specific material and can be any appropriate material, such as sintered body or the like.

(Fourth Embodiment)

The shown embodiment differentiates the sweeping member in the third embodiment of the ink-jet printing apparatus. Namely, in the third embodiment, the independently operable sweeping member is provided for each printing head. In contrast to this, the shown embodiment is provided single sweeping member corresponding to all of the printing heads.

A timing to perform sweeping operation is determined in the similar manner as the timing of the wiping operation in the first embodiment. Namely, by providing the threshold value similar to the first embodiment, when the dot counted value of any one of the printing heads exceeds the threshold value, sweeping operation is performed. In this case, since the single sweeping member is employed for all of the printing heads, sweeping operation is performed for all of the printing heads. Associating with this, the dot counted values of all of the printing heads are initialized simultaneously.

As a result, deposition of the mixture mist exceeding the predetermined amount can be prevented in all of the printing heads.

It should be noted that the constant K used for deriving the threshold value in the shown embodiment is the same as that of the third embodiment.

(Fifth Embodiment)

In the shown embodiment, in the first embodiment of the ink-jet printing apparatus, recovery processes of the printing head depending upon kinds of the ink are differentiated. However, in the shown embodiment, each of the printing heads 1*s*, 1*k*, 1*c*, 1*m* and 1*y* has 600 nozzles in a density of 600 per inch. Form each nozzle, about 20 ng of the processing liquid or the ink is ejected. Accordingly, printing density in the auxiliary scanning direction is 600 dpi. Associating with this, the printing density of the primary scanning direction becomes 600 dpi.

In case of the shown embodiment, the same the ink and the same processing liquid as those in the first embodiment are used. The threshold values ti to be compared with the dot counted value of the printing heads 1*k*, 1*c*, 1*m* and 1*y*, namely, the threshold values $t_k$, $t_c$, $t_m$ and $t_y$ are set at the following mutually different values.

$t_k$=46886400

$t_c$=31257600

$t_m$=62515200

$t_y$=62515200

In the shown embodiment, these threshold values are set corresponding to coagulation ability of respective color inks. At higher ink coagulation ability and/or coagulation ability of the ink mist of the ink and the processing liquid, possibility of deposition of the mixture mist becomes higher to make influence for printing precision greater. In case of the shown embodiment, coagulation ability of the cyan ink is higher than that of other inks. The black ink has high coagulation ability next to the cyan ink. Therefore, the threshold value $t_c$ for the printing head 1*c* for the cyan ink is set the smallest, and the threshold value $t_k$ for the printing head 1*k* for the black ink is set to be small next to $t_c$.

Then, when the dot counted value of any one of the printing heads for the inks exceeds the corresponding threshold value, wiping operation is performed only for the printing head of the relevant ink and the printing head for the processing liquid. Thereafter, the dot counted values corresponding to the printing heads, for which the wiping operation is performed, are initialized. As a result, concerning any of the printing head, deposition of the mixture mist exceeding the predetermined amount can be prevented. Furthermore, lowering of throughput by wiping can be minimized.

It should be noted that, in the shown embodiment, order of arrangement of the printing heads is in sequential order of the processing liquid, the black ink, the cyan ink, the magenta ink and the yellow ink. However, application of the present invention is not specified to the shown order and number.

On the other hand, elapsed time from the former recovery operation set for each printing head, for example, may be taken as a reference for performing recovery process. Namely, a predetermined reference period for each printing head of the ink is determined as the threshold value. For the printing heads for the inks and the printing head for the processing liquid, in which the elapsed period from former recovery operation exceeds the reference period, recovery operation is performed. In this case, depending upon kind of the ink, the reference period is set. Furthermore, the similar result can be obtained by varying number of times of recovery operation depending upon kind of the ink. Namely, with setting the timing of the recovery operation the same for all of the printing heads, number of times of recovery operation in the same timing can be varied depending upon kind of the ink.

(Sixth Embodiment)

The shown embodiment differentiates the operating condition of the wiping in the fifth embodiment of the ink-jet printing apparatus. Namely, in the fifth embodiment, similarly to the first embodiment, five wiper blades corresponding to respective printing heads and operated independently are provided. In contrast to this, the shown embodiment has single wiper blade 6 (not shown) corresponding to the printing heads 1*s*, 1*k*, 1*c*, 1*m* and 1*y*. Namely, the wiper blade 6 is an integrated type which can perform wiping for all of the printing heads 1*s*, 1*k*, 1*c*, 1*m* and 1*y*.

A timing of performing wiping is determined in the same manner as the fifth embodiment. Namely, similarly to the fifth embodiment, by providing the threshold value, wiping is performed when dot counted value of any one of the printing head exceeds the threshold value. In this case, as set forth above, since the shown embodiment has a construction employing an integrated type wiper blade, wiping is performed for all of the printing heads. Then, dot counted values of all of the printing heads are initialized simultaneously.

As a result of the process set forth above, similarly to the first embodiment, it becomes possible to prevent the mixture mist from depositing exceeding a predetermined amount on any printing heads. Also, lowering of throughput by wiping can be minimized.

It should be noted that, in the shown embodiment, the same ink and the same processing liquid as those used in the first embodiment are used.

It should be noted that, in the shown embodiment, order of arrangement of the printing heads is in sequential order of the processing liquid, the black ink, the cyan ink, the magenta ink and the yellow ink. However, application of the present invention is not specified to the shown order and number.

On the other hand, elapsed time from the former recovery operation set for each printing head, for example, may be taken as a reference for performing recovery process. Namely, a predetermined reference period for each printing head for the ink is determined as the threshold value. For the printing heads for the inks and the printing head for the processing liquid, in which the elapsed period from former recovery operation exceeds the reference period, recovery operation is performed. In this case, depending upon kind of the ink, the reference period is set.

(Seventh Embodiment)

In the shown embodiment, in place of the recovery process by the wiping in the fifth embodiment of the ink-jet printing apparatus, recovery process by suction of the inks and the processing liquid from the printing heads is performed. For example, by introducing a vacuum pressure into the cap with capping the printing head, for example, the ink and the processing liquid are sucked from the ejection openings of the printing heads. Such recovery process by suction is performed when the dot counted value per the printing head exceeds the predetermined threshold value, similarly to the recovery process by wiping of the fifth embodiment.

Particularly the threshold values $t_i$, namely $t_k$, $t_c$, $t_m$ and $t_y$ to be compared to the dot counted values of the printing heads 1*k*, 1*c*, 1*m* and 1*y* are set the following mutually different values.

$t_k$=95040000

$t_c$=31680000

$t_m$=126720000

$t_y$=126720000

In the shown embodiment, these threshold values are set corresponding to coagulation ability of respective color inks. At higher coagulation ability of the ink and the processing liquid, possibility of deposition of the mixture mist becomes higher to make influence for printing precision greater. In case of the shown embodiment, coagulation ability of the cyan ink is higher than that of other inks. The black ink has high coagulation ability next to the cyan ink. Therefore, the threshold value $t_c$ for the printing head 1*c* for the cyan ink is set the smallest, and the threshold value $t_k$ for the printing head 1*k* for the black ink is set to be small next to $t_c$.

Then, when the dot counted value of any one of the printing heads for the ink exceeds the corresponding threshold value, wiping operation is performed only for the printing head of the relevant ink and the printing head for the processing liquid. Thereafter, the dot counted values corresponding to the printing heads, for which the wiping operation is performed, are initialized. As a result, concerning any of the printing head, deposition of the mixture mist exceeding the predetermined amount can be prevented. Furthermore, lowering of throughput by wiping can be minimized.

It should be noted that, in the shown embodiment, order of arrangement of the printing heads is in sequential order of the processing liquid, the black ink, the cyan ink, the magenta ink and the yellow ink. However, application of the present invention is not specified to the shown order and number.

On the other hand, elapsed time from the former recovery operation set for each printing head, for example, may be taken as a reference for performing recovery process. Namely, a predetermined reference period for each printing head for the ink is determined as the threshold value. For the printing head for the ink and the printing head for the processing liquid, in which the elapsed period from former recovery operation exceeds the reference period, recovery operation is performed. In this case, depending upon kind of the ink, the reference period is set. Furthermore, the similar result can be obtained by varying number of times of the recovery operation depending upon kind of the ink. Namely, with setting the timing of the recovery operation the same for all of the printing heads, number of times of recovery operation in the same timing can be varied depending upon kind of the ink.

(Eighth Embodiment)

The shown embodiment performs recovery operation of the printing head by combining the recovery process by wiping operation of the integrated type wiper blade 6 of the sixth embodiment and the recovery process by suction of the seventh embodiment.

Namely, the timing to implement the recovery process by wiping is determined in the similar manner to the sixth embodiment. Namely, by providing the threshold value similar to the fifth embodiment, wiping operation is performed at a timing at which the dot counted value of any one of the printing head exceeds the threshold value. In this case, since the integrated type wiper blade 6 is used, the recovery operation by wiping is performed for all of the heads. Then, the dot counted values for wiping of all of the printing heads are initialized simultaneously.

On the other hand, the timing to perform the recovery process by suction is determined by setting the threshold value for suction recovery in similar manner to the foregoing seventh embodiment. When the dot counted value of any one of the printing head exceeds the threshold value, suction is performed only for the printing head for the relevant ink and the printing head for the processing liquid. At the same timing, the recovery process by wiping is performed. Thus, together with the dot counted value for suction recovery, the dot counted value for wiping can be cleared.

As a result of the foregoing process, for any of the printing heads, deposition of the mixture mist exceeding the predetermined amount can be prevented successfully. Also, lowering of throughput by the foregoing recovery process can be minimized.

It should be noted that, in the shown embodiment, the same ink and the same processing liquid as those used in the first embodiment are used.

It should be noted that, in the shown embodiment, order of arrangement of the printing heads is in sequential order of the processing liquid, the black ink, the cyan ink, the magenta ink and the yellow ink. However, application of the present invention is not specified to the shown order and number.

On the other hand, elapsed time from the former recovery operation set for each printing head, for example, may be taken as a reference for performing recovery process. Namely, a predetermined reference period for each printing head of the ink is determined as the threshold value. For the printing head for the ink and the printing head for the processing liquid, in which the elapsed period from former recovery operation exceeds the reference period, recovery operation is performed. In this case, depending upon kind of the ink, the reference period is set.

It should be noted that, in the shown embodiment, the same ink and the processing liquid as those used in the fifth embodiment are used.

It should be noted that, in the shown embodiment, order of arrangement of the printing heads is in sequential order of the processing liquid, the black ink, the cyan ink, the magenta ink and the yellow ink. However, application of the present invention is not specified to the shown order and number.

On the other hand, elapsed time from the former recovery operation set for each printing head, for example, may be taken as a reference for performing recovery process. Namely, a predetermined reference period for each printing head for the ink is determined as the threshold value. For the printing head for the ink and the printing head for the processing liquid, in which the elapsed period from former recovery operation exceeds the reference period, recovery operation is performed. In this case, depending upon kind of the ink, the reference period is set.

(Other Embodiment)

While only wiping operation is performed as the recovery process of the printing head in the foregoing first and second embodiments, it may be possible to combine with the recovery process for sucking the ink and the processing liquid from the ejection openings of the respective printing heads. On the other hand, similarly, while only sweeping operation is performed as the recovery process in the second and third embodiment, it may be possible to combine with the recovery process for sucking the ink and the processing liquid from ink ejection openings of the respective printing heads. Furthermore, as the recovery method of the printing heads, in addition to the foregoing wiping, sweeping and suction operation, a preparatory ejection to perform ink ejection not contributing for printing of the image from the printing head may be combined.

On the other hand, in the foregoing first to fourth embodiment, the head is constructed with the printing heads 1*s*, 1*k*, 1*c*, 1*m* and 1*y*, a printing head 1*k*2 may be newly added to arrange the printing heads in sequential order of 1*k*2, 1*s*, 1*k*, 1*c*, 1*m* and 1*y* along the primary scanning direction. In this case, the operating condition of the recovery process of the printing head is can be set depending upon the distance from the printing head 1*k*2 (, and/or the kind of the ink ejected by the printing head 1*k*2).

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C. −70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

Here, as an example, the processing liquid or solution for making ink dyestuff insoluble can be obtained in the following manner.

Specifically, after the following components are mixed together and dissolved, and the mixture is pressure-filtered by using a membrane filter of 0.22 μm in pore size (tradename: fuloropore filter manufactured by Sumitomo Electric Industries, Ltd.), and thereafter, pH of the mixture is adjusted to a level of 4.8 by adding sodium hydroxide whereby liquid A1 can be obtained.

| [components of A1] | |
|---|---|
| low molecular weight ingredients of cationic compound; stearyl-trimethyl ammonium salts (tradename: Electrostriper QE, manufactured by Kao Corporation), or stearyl-trimethyl ammonium chloride (tradename: Yutamine 86P, manufactured by Kao Corporation) | 2.0 parts by weight |
| high molecular weight ingredients of cationic compound; copolymer of diarylamine hydrochloride and sulfur dioxide (having an average molecular weight of 5000) (tradename: polyaminesulfon PAS-92, manufactured by Nitto Boseki Co., Ltd) | 3.0 parts by weight |
| thiodiglycol; | 10 parts by weight |
| water | balance |

Preferable examples of ink which becomes insoluble by mixing the aforementioned processing liquid can be noted below.

Specifically, the following components are mixed together, the resultant mixture is pressure-filtered with the use of a membrane filter of 0.22 μm in pore size (tradename: Fuloroporefilter, manufactured by Sumitomo Electric Industries, Ltd.) so that yellow ink Y1, magenta ink M1, cyan ink C1 and black ink K1 can be obtained.

[Yellow ink Y1]

| | |
|---|---|
| C. I. direct yellow 142 | 2 parts by weight |
| thiodiglycol | 10 parts by weight |
| acetynol EH (tradename manufactured by Kawaken Fine Chemical Co., Ltd.) | 0.05 parts by weight |
| water | balance |

[Magenta ink M1]

having the same composition as that of Y1 other than that the dyestuff is changed to 2.5 parts by weight of C. I. acid red 289.

[Cyan ink C1]

having the same composition as that of Y1 other than that the dyestuff is changed to 2.5 parts by weight of acid blue 9.

[Black ink K1]

having the same composition as that of Y1 other than that the dyestuff is changed to 3 parts by weight of C. I. food black 2.

According to the present invention, the aforementioned processing liquid and ink are mixed with each other at the position on the printing medium or at the position where they penetrate in the printing medium. As a result, the ingredient having a low molecular weight or cationic oligomer among the cationic material contained in the processing liquid and the water soluble dye used in the ink having anionic radical are associated with each other by an ionic mutual function as a first stage of reaction whereby they are instantaneously separated from the solution liquid phase.

Next, since the associated material of the dyestuff and the cationic material having a low molecular weight or cationic oligomer are adsorbed by the ingredient having a high molecular weight contained in the processing liquid as a second stage of reaction, a size of the aggregated material of the dyestuff caused by the association is further increased, causing the aggregated material to hardly enter fibers of the printed material. As a result, only the liquid portion separated from the solid portion permeates into the printed paper, whereby both high print quality and a quick fixing property are obtained. At the same time, the aggregated material formed by the ingredient having a low molecular weight or the cationic oligomer of the cationic material and the anionic dye by way of the aforementioned mechanism, has increased viscosity. Thus, since the aggregated material does not move as the liquid medium moves, ink dots adjacent to each other are formed by inks each having a different color at the time of forming a full colored image but they are not mixed with each other. Consequently, a malfunction such as bleeding does not occur. Furthermore, since the aggregated material is substantially water-insoluble, water resistibility of a formed image is complete. In addition, light resistibility of the formed image can be improved by the shielding effect of polymer.

By the way, the term "insoluble" or "aggregation" refers to observable events in only the above first stage or in both the first and second stages.

When the present invention is carried out, since there is no need of using the cationic material having a high molecular weight and polyvalent metallic salts like the prior art or even though there is need of using them, it is sufficient that they are assistantly used to improve an effect of the present invention, a quantity of usage of them can be minimized. As a result, the fact that there is no reduction of a property of color exhibition that is a problem in the case that an effect of water resistibility is asked for by using the conventional cationic high molecular weight material and the polyvalent metallic salts can be noted as another effect of the present invention.

With respect to a printing medium usable for carrying out the present invention, there is no specific restriction, so called plain paper such as copying paper, bond paper or the like conventionally used can preferably be used. Of course, coated paper specially prepared for ink jet printing and OHP transparent film are preferably used. In addition, ordinary high quality paper and bright coated paper can preferably be used.

Ink usable for carrying out the present invention should not be limited only to dyestuff ink, and pigment ink having pigment dispersed therein can also be used. Any type of processing liquid can be used, provided that pigment is aggregated with it. The following pigment ink can be noted as an example of pigment ink adapted to cause aggregation by mixing with the processing liquid A1 previously discussed. As mentioned below, yellow ink Y2, magenta ink M2, cyan ink C2 and black ink K2 each containing pigment and anionic compound can be obtained.

[Black ink K2]

The following materials are poured in a batch type vertical sand mill (manufactured by Aimex Co.), glass beads each having a diameter of 1 mm is filled as media using anion based high molecular weight material P-1 (aqueous solution containing a solid ingredient of styrene methacrylic acid ethylacrylate of 20% having an acid value of 400 and average molecular weight of 6000, neutralizing agent: potassium hydroxide) as dispersing agent to conduct dispersion treatment for three hours while water-cooling the sand mill. After completion of dispersion, the resultant mixture has a viscosity of 9 cps and pH of 10.0. The dispersing liquid is poured in a centrifugal separator to remove coarse particles, and a carbon black dispersing element having a weight-average grain size of 10 nm is produced.

| (Composition of carbon black dispersing element) | |
|---|---|
| P-1 aqueous solution (solid ingredient of 20%) | 40 parts |
| carbon black Mogul L (tradename: manufactured by Cablack Co.) | 24 parts |
| glycerin | 15 parts |
| ethylene glycol monobutyl ether | 0.5 parts |
| isopropyl alcohol | 3 parts |
| water | 135 parts |

Next, the thus obtained dispersing element is sufficiently dispersed in water, and black ink K2 containing pigment for ink jet printing is obtained. The final product has a solid ingredient of about 10%.

[Yellow ink Y2]

Anionic high molecular P-2 (aqueous solution containing a solid ingredient of 20% of stylenacrlylic acid methyl methaacrylate having an acid value of 280 and an average molecular weight of 11,000, neutralizing agent: diethanolamine) is used as a dispersing agent and dispersive treatment is conducted in the same manner as production of the black ink K2 whereby yellow color dispersing element having a weight-average grain size of 103 nm is produced.

| (composition of yellow dispersing element) | |
|---|---|
| P-2 aqueous solution (having a solid ingredient of 20%) | 35 parts |
| C. I. pigment yellow 180 (tradename: Nobapalm yellow PH-G, manufactured by Hoechst Aktiengesellschaft) | 24 parts |
| triethylen glycol | 10 parts |
| diethylenglycol | 10 parts |
| ethylene glycol monobutylether | 1.0 parts |
| isopropyl alcohol | 0.5 parts |
| water | 135 parts |

The thus obtained yellow dispersing element is sufficiently dispersed in water to obtain yellow ink Y2 for ink jet printing and having pigment contained therein. The final product of ink contains a solid ingredient of about 10%.

[Cyan ink C2]

Cyan colored-dispersant element having a weight-average grain size of 120 nm is produced by using the anionic high molecular P-1 used when producing the black ink K2 as dispersing agent, and moreover, using the following materials by conducting dispersing treatment in the same manner as the carbon black dispersing element.

| (composition of cyan colored-dispersing element) | |
|---|---|
| P-1 aqueous solution (having solid ingredient of 20%) | 30 parts |
| C. I. pigment blue 153 (tradename: Fastogen blue FGF, manufactured by Dainippon Ink And Chemicals, Inc.) | 24 parts |
| glycerin | 15 parts |
| diethylenglycol monobutylether | 0.5 parts |
| isopropyl alcohol | 3 parts |
| water | 135 parts |

The thus obtained cyan colored dispersing element is sufficiently stirred to obtain cyan ink C2 for ink jet printing and having pigment contained therein. The final product of ink has a solid ingredient of about 9.6%.

[Magenta ink M2]

Magenta color dispersing element having a weight-average grain size of 115 nm is produced by using the anionic high molecular P-1 used when producing the black ink K2 as dispersing agent, and moreover, using the following materials in the same manner as that in the case of the carbon black dispersing agent.

| (composition of the magenta colored dispersing element) | |
|---|---|
| P-1 aqueous solution (having a solid ingredient of 20%) | 20 parts |
| C. I. pigment red 122 (manufactured by Dainippon Ink And Chemicals, Inc.) | 24 parts |
| glycerin | 15 parts |
| isopropyl alcohol | 3 parts |
| water | 135 parts |

Magenta ink M2 for ink jet printing and having pigment contained therein is obtained by sufficiently dispersing the magenta colored dispersing element in water. The final product of ink has a solid ingredient of about 9.2%.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink-jet printing apparatus for printing an image on a printing medium by an ink and a processing liquid for making insoluble a coloring material in the ink, said apparatus comprising:

a plurality of ink ejecting heads which can eject the ink;

a processing liquid ejecting head which can eject the processing liquid;

an ejection recovery means for recovering an ejection from said plurality of ink ejecting heads and/or said processing liquid ejecting head; and an ejection recovery condition differentiating means for differentiating an ejection recovery condition for recovering the ejection from said plurality of ink ejecting heads and/or said processing liquid ejecting head by said ejecting recovery means depending upon the possibility of causing deposition of the ink and/or the processing liquid rebounded from the printing medium onto said plurality of ink ejecting heads and/or said processing liquid ejecting head.

2. An ink-jet printing apparatus as claimed in claim 1, wherein said respective ejection recovery condition of said plurality of ink ejecting heads are differentiated depending upon kinds of the inks ejected from said ink ejecting heads.

3. An ink-jet printing apparatus as claimed in claim 2, wherein said ejection recovery condition is set such that the frequency of the ejection recovery process is increased, as the coagulation ability of the ink is higher.

4. An ink-jet printing apparatus as claimed in claim 2, wherein said ejection recovery condition is set such that the frequency of the ejection recovery process is increased, as the mixture mist of the ink and the processing liquid is higher.

5. An ink-jet printing apparatus as claimed in claim 2, wherein said ejection recovery condition is to count the number of ejection times of said respective plurality of ink ejecting heads and to perform an ejection recovery process for at least the relevant ink ejecting head when said count value derived from the count of the number of ejection times exceeds respective predetermined values determined depending upon kinds of said inks.

6. An ink-jet printing apparatus as claimed in claim 2, wherein elapsed periods from former ejection recovery operation are measured for respective of said plurality of ink ejecting heads, and perform an ejection recovery process for the at least relevant ink ejecting head when said respective elapsed periods exceed respective of predetermined periods determined depending upon kinds of said inks.

7. An ink-jet printing apparatus as claimed in claim 2, wherein number of times of said ejection recovery process for said respective ink ejecting head is differentiated depending upon kinds of said inks.

8. An ink-jet printing apparatus as claimed in claim 2, wherein said ejection recovery process is at least any one of wiping of said ink ejecting heads and said processing liquid ejecting head, sweeping operation of said ink ejecting heads and said processing liquid ejecting head, preparatory ejection of the ink or the processing liquid from said ink ejecting heads and said processing liquid ejecting head, suction of the ink or the processing liquid from the ink ejecting heads and said processing liquid ejecting head.

9. An ink-jet printing apparatus as claimed in claim 2, wherein said ink ejecting heads and said processing liquid ejecting head generates a bubble in the ink or the processing liquid using a thermal energy and ejects the ink or the processing liquid by the pressure of the bubble.

10. An ink-let printing apparatus for printing an image on a printing medium by an ink and a processing liquid for making a coloring material in the ink insoluble, said apparatus comprising:

a plurality of ink ejecting heads which can eject the ink;

a processing liquid ejecting head which can eject the processing liquid;

an ejection recovery means for recovering an ejection from said plurality of ink ejecting heads and/or said processing liquid ejecting head; and an ejection recovery condition differentiating means for differentiating an ejection recovery condition for recovering the ejection from said plurality of ink ejecting heads and/or said processing liquid ejecting head by said ejecting recovery means depending upon the distances between said plurality of ink ejecting printing heads and said processing liquid ejecting head.

11. An ink-jet printing apparatus as claimed in claim 10, wherein said ejection recovery condition is set such that a process amount of the ejection recovery is greater, as said distance is shorter.

12. An ink-jet printing apparatus as claimed in claim 10, wherein said ejection recovery condition is to respectively count the number of ejection times of said plurality of ink ejecting heads and to perform an ejection recovery process for at least the relevant ink ejecting head when said respective count value derived from the count of the number of ejection times exceeds respective predetermined values determined depending upon said distances.

13. An ink-jet printing apparatus as claimed in claim 10, wherein elapsed periods from former ejection recovery operation are measured for respective of said plurality of ink ejecting heads, and perform an ejection recovery process for the at least relevant ink ejecting head when said respective elapsed periods exceed respective of predetermined periods determined depending upon said distance.

14. An ink-jet printing apparatus as claimed in claim 10, wherein number of times of said ejection recovery process for said respective ink ejecting head is differentiated depending upon said respective distances.

15. An ink-jet printing apparatus as claimed in claim 10, wherein said ejection recovery process is at least any one of wiping of said ink ejecting heads and said processing liquid ejecting head, sweeping operation of said ink ejecting head and said processing liquid ejecting head, preparatory ejection of the ink or the processing liquid from said ink ejecting heads and said processing liquid ejecting head, suction of the ink or the processing liquid from the ink ejecting heads and said processing liquid ejecting head.

16. An ink-jet printing apparatus as claimed in claim 10, wherein said ink ejecting heads and said processing liquid ejecting head generates a bubble in the ink or the processing liquid using a thermal energy and ejects the ink or the processing liquid by the pressure of the bubble.

17. An ink-jet printing apparatus for printing an image on a printing medium by an ink and a processing liquid for making a coloring material in the ink insoluble, said apparatus comprising:

a plurality of ink ejecting portions which can eject the ink;

a processing liquid ejecting portion which can eject the processing liquid;

an ejection recovery means for recovering an ejection from said plurality of ink ejecting portions and/or said processing liquid ejecting portion; and an ejection recovery condition differentiating means for differentiating an ejection recovery condition for recovering the ejection from said plurality of ink ejecting portions and/or said processing liquid ejecting portion by said ejecting recovery means depending upon the possibility of causing deposition of the ink and/or the processing liquid rebounded from the printing medium onto said plurality of ink ejecting portions and/or said processing liquid ejecting portion.

18. An ink-jet printing apparatus as claimed in claim 17, wherein said respective ejection recovery condition of said plurality of ink ejecting portions are differentiated depending upon kinds of the inks ejected from said ink ejecting portions.

19. An ink-jet printing apparatus as claimed in claim 18, wherein said ink ejecting portions and said processing liquid ejecting portion generates a bubble in the ink or the processing liquid using a thermal energy and ejects the ink or the processing liquid by the pressure of the bubble.

20. An ink jet printing apparatus for printing an image on a printing medium by an ink and a processing liquid for making a coloring material in the ink insoluble, said apparatus comprising:

a plurality of ink ejecting portions which can eject the ink;

a processing liquid ejecting portion which can eject the processing liquid;

an ejection recovery means for recovering an ejection from said plurality of ink ejecting portions and/or said processing liquid ejecting portion;

an ejection recovery condition differentiating means for differentiating an ejection recovery condition for recovering the ejection from said plurality of ink ejecting portions and/or said processing liquid ejecting portion by said ejection recovery means depending upon the distances between said plurality of ink ejecting portions and said processing liquid ejecting portion.

21. An ink-jet printing apparatus as claimed in claim 20, wherein said ink ejecting portions and said processing liquid ejecting portion generates a bubble in the ink or the processing liquid using a thermal energy and ejects the ink or the processing liquid by the pressure of the bubble.

22. An ejection recovery method for an ink-jet printing apparatus using a plurality of ink ejecting heads which can eject an ink and a processing liquid ejected head which can eject a processing liquid for making a coloring material in the ink insoluble, said method comprising the steps of:

printing an image on a printing medium by ejecting the ink from said plurality of ink ejecting heads and by ejecting the processing liquid from said processing liquid ejecting head; and recovering an ejection from said plurality of ink ejecting heads and/or said processing liquid ejecting head corresponding to an ejection recovery condition differentiated depending upon the possibility of causing deposition of the ink and/or the processing liquid rebounded from the printing medium onto said plurality of ink ejecting heads and/or said processing liquid ejecting head.

23. An ejection recovery method as claimed in claim 22, wherein said respective of ejection recovery condition of said plurality of ink ejecting heads are differentiated depending upon kinds of the inks ejected from said ink ejecting heads.

24. An ejection recovery method for an ink-jet printing apparatus using a plurality of ink ejecting heads which can eject an ink and a processing liquid ejecting head which can eject a processing liquid for making a coloring material in the ink insoluble, said method comprising the steps of:

printing an image on a printing medium by ejecting the ink from said plurality of ink ejecting portions and by ejecting the processing liquid from said processing liquid ejecting head; and recovering an ejection from said plurality of ink ejecting heads and/or said processing liquid ejecting head corresponding to an ejection recovery condition differentiated depending upon the distances between said plurality of ink ejecting heads and said processing liquid ejecting head.

25. An ejection recovery method for an ink-jet printing apparatus using a plurality of ink ejecting portions which can eject an ink and a processing liquid ejecting portion which can eject a processing liquid for making a coloring material in the ink insoluble, said method comprising the steps of:

printing an image on a printing medium by ejecting the ink from said plurality of ink ejecting heads and by ejecting the processing liquid from said processing liquid ejecting portion; and recovering an ejection from said plurality of ink ejecting portions and/or said processing liquid ejecting portion corresponding to an ejection recovery condition differentiated depending upon the possibility of causing deposition of the ink and/or the processing liquid rebounded from the printing medium onto said plurality of ejecting portions and/or said processing liquid ejecting portion.

26. An ejection recovery method as claimed in claim 25, wherein said respective of ejection recovery condition of said plurality of ink ejecting portions are differentiated depending upon kinds of the inks ejected from said ink ejecting portions.

27. An ejection recovery method for an ink-jet printing apparatus using a plurality of ink ejecting portions which can eject an ink and a processing liquid ejecting portion which can eject a processing liquid for making a coloring material in the ink insoluble, said method comprising the steps of:

printing an image on a printing medium by ejecting the ink from said plurality of ink ejecting portions and by ejecting the processing liquid from said processing liquid ejecting portion; and recovering an ejection from said plurality of ink ejecting portions and/or said processing liquid ejecting portion corresponding to an ejection recovery condition differentiated depending upon the distances between said plurality of ink ejecting portions and said processing liquid ejecting portion.

* * * * *

UNITED STATES PATENT AND TRADEMARK OFFICE

CERTIFICATE OF CORRECTION

PATENT NO. : 6,231,156 B1
DATED : May 15, 2001
INVENTOR(S) : Mitsuhiro Ono

It is certified that error appears in the above-identified patent and that said Letters Patent is hereby corrected as shown below:

Title page,
Item [57], ABSTRACT, "ejection" should read -- ejections --.

Column 1,
Line 21, "clothes," should read -- cloth, --; and
Line 53, "scan," should read -- scans, --.

Column 2,
Line 34, "obtain" should read -- which can obtain --;
Line 36, "and" should be deleted; and
Line 44, "require" should read -- requiring --.

Column 3,
Line 21, "cased" should read -- caused --.

Column 4,
Line 1, "solidifying" should read -- solidifying and --.

Column 5,
Line 12, "illustration" should read -- illustrations --; and
Line 16, "droplet" should read -- droplets --.

Column 7
Line 58, "head is," should read -- heads 1s, --.

Column 9,
Line 36, "cc." should read -- cc, --; and
Line 48, "head is" should read -- head 1s --.

Column 12,
Line 43, "the ink" should read -- ink --; and
Line 45, "ti" should read -- $t_i$ --.

Column 16,
Line 32, "(, and/or" should read -- (and/or --;
Line 34, "effect" should read -- effects --.

Column 17,
Line 8, "Laying-open" should read -- Laid-open --.

UNITED STATES PATENT AND TRADEMARK OFFICE

CERTIFICATE OF CORRECTION

PATENT NO. : 6,231,156 B1
DATED : May 15, 2001
INVENTOR(S) : Mitsuhiro Ono

It is certified that error appears in the above-identified patent and that said Letters Patent is hereby corrected as shown below:

Column 18,
Line 10, "Laying-open" should read -- Laid-open --; and
Line 24, "fuloropore" should read -- Fuloropore --.

Column 22,
Line 46, "wherein" should read -- wherein each of --;
Line 50, "ink-let" should read -- ink-jet --; and
Line 66, "printing" should be deleted.

Column 23,
Line 21, "head" should read -- heads --;
Line 25, "head" (second occurrence) should read -- heads --; and
Line 57, "condition" should read -- conditions --.

Column 24,
Line 23, "ejected" should read -- ejecting --;
Line 40, "condition" should read -- conditions --;
Line 50, "portions" should read -- heads --; and
Line 67, "heads" should read -- portions --.

Column 25,
Line 12, "condition" should read -- conditions --.

Signed and Sealed this

Fifth Day of March, 2002

*Attest:*

*Attesting Officer*

JAMES E. ROGAN
*Director of the United States Patent and Trademark Office*